United States Patent [19]

Davis

[11] 3,961,330

[45] June 1, 1976

[54] ANTENNA SYSTEM UTILIZING CURRENTS IN CONDUCTIVE BODY

[76] Inventor: Ross Alan Davis, 724 Ala Moana Blvd., Honolulu, Hawaii 96813

[22] Filed: Feb. 24, 1975

[21] Appl. No.: 552,569

Related U.S. Application Data

[63] Continuation of Ser. No. 427,258, Dec. 21, 1973, abandoned.

[52] U.S. Cl. ..... 343/712; 343/748

[51] Int. Cl.[2] ..... H01Q 1/32

[58] Field of Search ..... 343/711, 712, 748

[56] References Cited

UNITED STATES PATENTS

| | | | |
|---|---|---|---|
| 2,318,516 | 5/1943 | Newbold | 343/702 |
| 3,409,891 | 11/1968 | Lode | 343/708 |
| 3,717,876 | 2/1973 | Volkers et al. | 343/712 |

*Primary Examiner*—Eli Lieberman

[57] ABSTRACT

An improved antenna system for the transmission and/or reception of electromagnetic signals is described which utilizes a region or regions of natural current concentration within the conductive portion or portions of fixed or mobile structures for the extraction or insertion of electromagnetic energy.

4 Claims, 9 Drawing Figures

Fig. 1
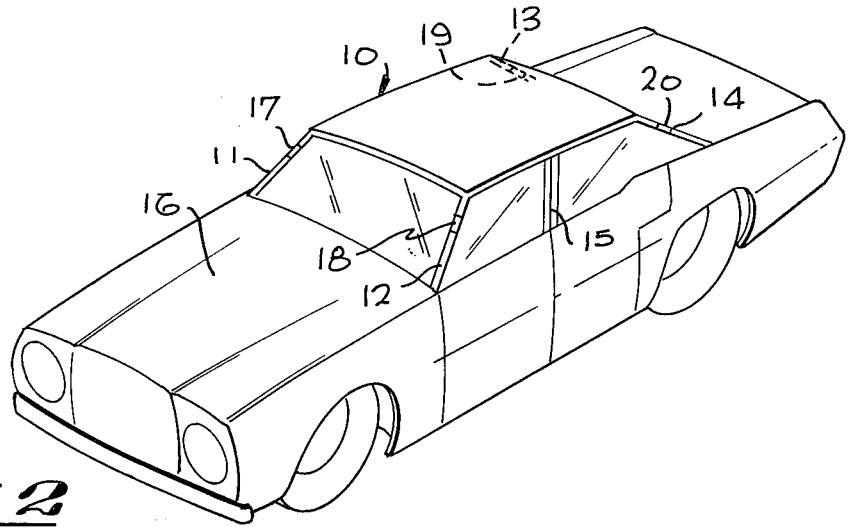
Fig. 2
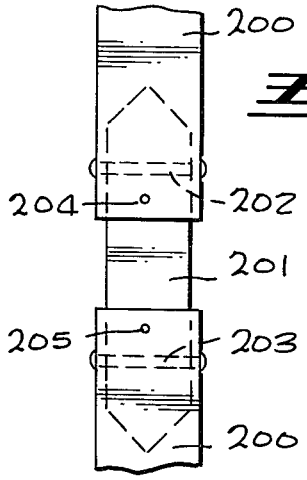
Fig. 7
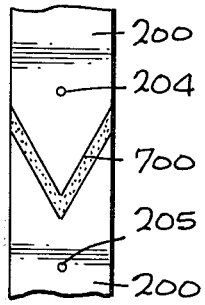
Fig. 4
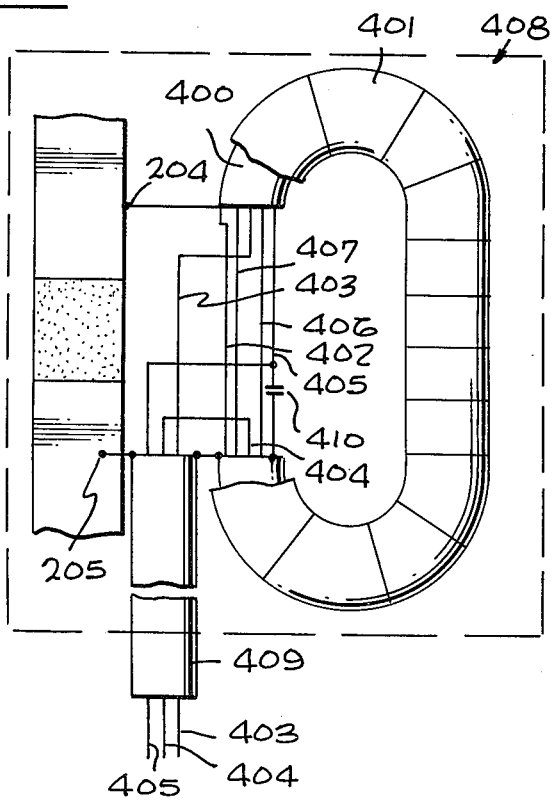
Fig. 3
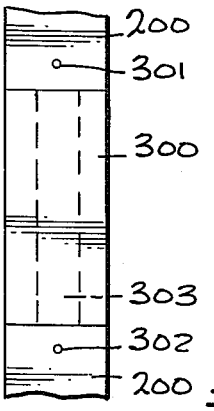
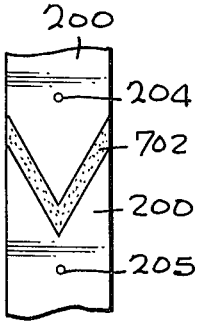
Fig. 7A Fig. 5
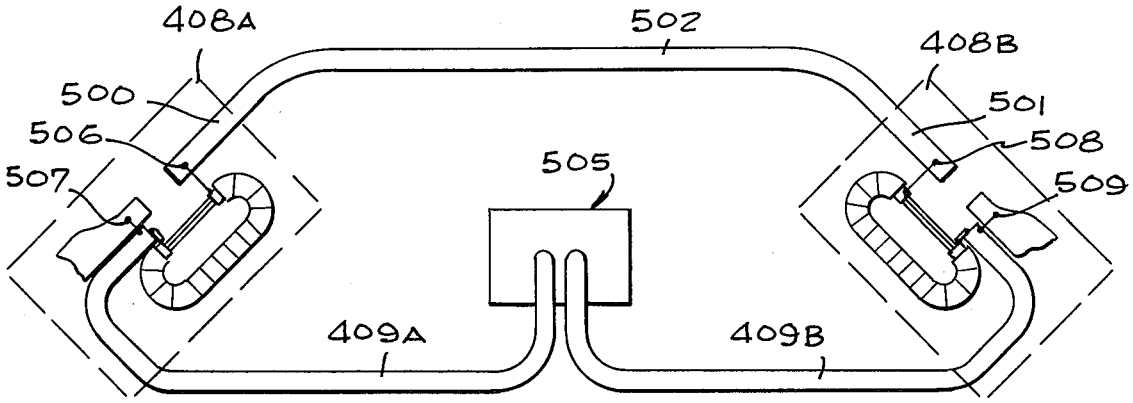
Fig. 6
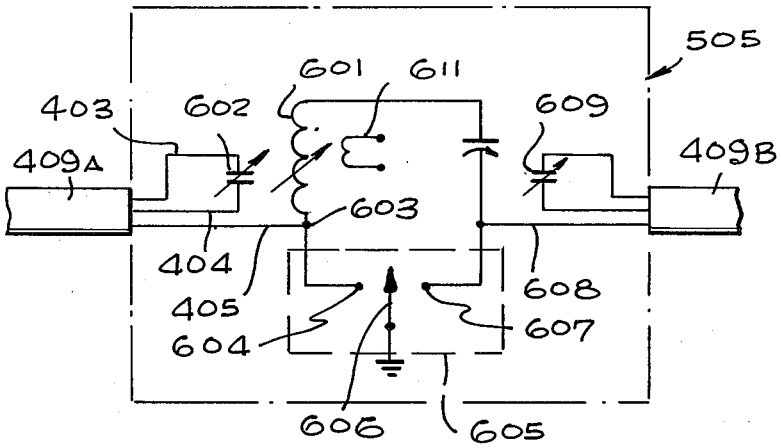
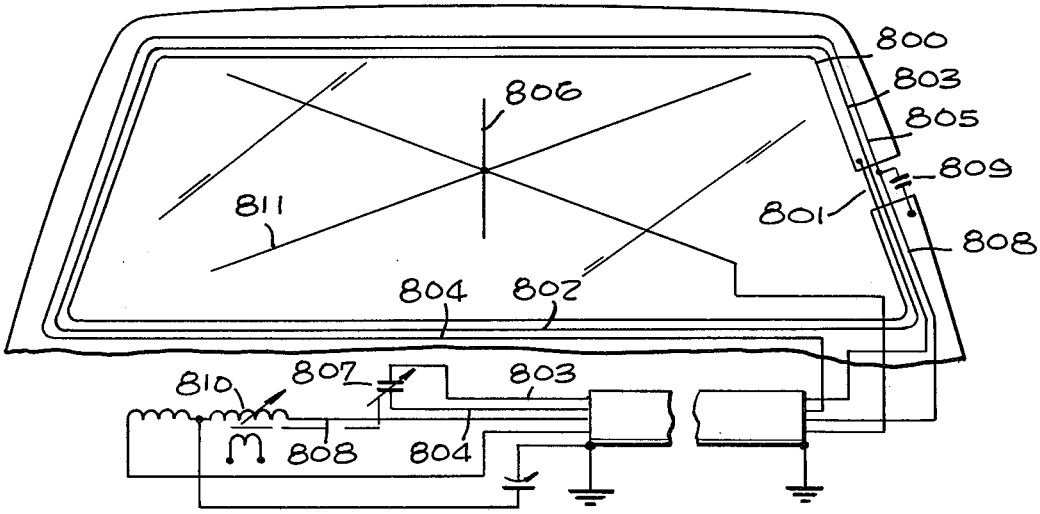
Fig. 8

ANTENNA SYSTEM UTILIZING CURRENTS IN CONDUCTIVE BODY

This is a continuation of application Ser. No. 427,258, filed Dec. 21, 1973, now abandoned.

RELEVANT APPLICATIONS

Application Ser. No. 427,259 filed Dec. 21, 1973, now Pat. No. 3,916,413 by this inventor and entitled Remotely Tuned Conductive-Body Antenna System; application Ser. No. 430,095 filed Jan. 2, 1974, now abandoned, by this inventor and entitled Improved Radio Frequency Transformer.

BACKGROUND OF THE INVENTION

In U.S. Pat. Nos. 2,923,813; 2,971,191; 3,007,164 and 3,066,293 the present inventor described several approaches to utilizing structures, such as automobile bodies, as transmitting or receiving antennas for radio waves. However, at the time of those inventions the present inventor was cognizant of the usability of only the boundary current flowing around the various discontinuities which are described in those patents, including discontinuities produced by the application of high-permeability ferrite materials over an area, as in FIG. 6*a* of U.S. Pat. No. 3,066,293. To stress this point once more, in the recited patents only currents flowing around an edge or boundary of a discontinuity in a conductive structure, e.g., a window in a vehicle, were utilized.

Only in recent experimentation was it discovered that by producing an impedance discontinuity in a region where currents were concentrated by reason of reduced cross section in the conductive body, as for example in a vertical column of a vehicle, a significant voltage drop could be produced across the current path impedance discontinuity, which voltage could be utilized very effectively to operate a radio receiver. The reciprocal phenomenon is also true, i.e., energy fed across such a discontinuity will be very effectively radiated by the conductive body. This use as a signal source or input of an impedance discontinuity in a region of reduced cross section, where body currents naturally are concentrated, rather than the boundary around a discontinuity, as previously taught, has been proved to produce a significantly more effective antenna system. To maximize the voltage drop across the impedance discontinuity and the coupling of energy into or out of the conductive body it is desirable to resonate, over the band of frequencies to be utilized, the inductive reactance appearing across the impedance discontinuity produced according to this invention.

While a single input or output region may be adequate for most applications, to minimize loss of signal because of directionality effects and to most nearly achieve omnidirectional-type performance, a plurality of separated regions of current concentration — for example two rear columns in an automobile — may be modified according to this invention to provide two space-phased antenna systems. Further, in the receiving mode, the voltage appearing across either or both of the current-flow discontinuities in the respective regions of current concentration can be "stepped up" by means of an auto-transformer preferably of the circuit configuration described in copending application Ser. No. 430,095 filed Jan. 2, 1974 by this inventor, although the configuration described in the previously recited patents may also be used.

BRIEF DESCRIPTION OF THE DRAWINGS

FIG. 1 is a representation of a conductive body having a plurality of useable impedance discontinuities in regions of current concentration, according to the present invention;

FIG. 2 is a diagram showing one means for producing a desired electrical impedance discontinuity while retaining structural strength;

FIG. 3 is a diagram showing a second method of producing an impedance discontinuity while retaining structural strength;

FIG. 4 is a diagram showing a method for coupling energy into or out of an impedance discontinuity such as any of those shown in FIG. 1 through 3;

FIG. 5 is a diagram showing a dual antenna system according to the present invention utilizing the coupling means of FIG. 4;

FIG. 6 is a schematic diagram of a radio receiver input circuit usable in connection with the antenna system of FIG. 5;

FIG. 7 is a diagram showing a third method for producing an impedance discontinuity while retaining structural strength;

FIG. 7A is a diagram representing a fourth method for producing an impedance discontinuity while retaining structural strength; and, FIG. 8 is a diagram showing a tuned system for extracting signals from a conductive body, according to the present invention.

DETAILED DESCRIPTION OF THE ILLUSTRATED EMBODIMENTS

For illustrative purposes only FIG. 1 shows a car body 10 which, in a large part, is electrically conductive and, when in an electromagnetic field or fields will have currents flowing through it at the frequencies of the energy in the field or fields.

Experiments have shown that these currents circulate through the body and tend to be concentrated in portions of relatively narrow cross-section, such as front columns 11 and 12, rear columns 13 and 14 and door column 15 and its counterpart, not shown, on the opposite side of the vehicle. Experiments have further shown that currents flowing through front columns 11 and 12 tend to return, in part, through column 15 and its counterpart, respectively. Similarly, currents flowing in rear columns 13 and 14 tend to return, in part, through column 15 and its counterpart, to the rear of the vehicle. As a result, currents flowing in columns 13 and 14 contain less electrical noise from the engine portion 16 of body 10. This partial elimination of noise from the signal extracted from columns 13 and 14 can be advantageous if the vehicle is operating in a region of low desired-signal strength and a receiving function is being performed. On the other hand the proximity of the front columns to the normal location of a radio receiver in a vehicle presents certain practical mechanical and electrical advantages.

While all four columns 11, 12, 13 and 14 are shown as having discontinuities therein, for most purposes a maximum of two such discontinuities, e.g., discontinuities 17 and 18 or 19 and 20, will be utilized for any one receiver or transmitter. It should be understood that a single discontinuity will be adequate in many applications. This, of course, simplifies mechanical problems and reduces the complexity of associated electrical circuits. However, tests indicate that the use of two or more discontinuities enhances to omnidirectionality of the present antenna system.

Methods for producing impedance discontinuities are set forth in FIGS. 2, 3, 7 and 7A.

In FIG. 2 column 200 has been severed and electrically non-conductive member 201 has been inserted. Member 201 must have mechanical strength as well as being electrically nonconductive. It should also be capable of being bonded or otherwise firmly secured to the two segments of severed column 200. Insert 201 may be made of plastic with reinforcing material such as glass fibers or a stiff metallic core therein. Insert 201 may be held in position by any one of several well known methods, as by pins 202 and 203 or by one of the many modern adhesives such as those of the epoxy family. Terminals 204 and 205 provide means for coupling to external circuits those signals appearing across the impedance discontinuity produced by insert 201.

Column 200, being conductive, has a natural impedance to alternating currents, particularly radio frequency alternating currents, flowing therethrough. That impedance is made up partially of resistance and partially of inductive reactance. Because the permeability of the material making up column 200 is normally quite low (the material being relatively high carbon steel) the natural inductive reactance for a length, say 1 foot, of column 200 is very low. However, by surrounding column 200 over a length of about 1 foot with high permeability ferrite material such as Ferramic 0-5 material having a permeability of about 3000 a significant increase in the inductive reactance of that portion of column 200 covered by ferrite material 300 can be realized. For aesthetic reasons it may be desirable to apply the Ferramic material over a region 303 of column 200 having reduced diameter. Ferramic is a registered trademark of the Indiana General Corporation and they manufacture the recited 0-5 material suggested for use in connection with this invention.

The increase in the inductive reactance of a portion of column 200 by a factor of about 3000 produces the desired impedance discontinuity which, in turn, produces a signal voltage drop across terminals 301 and 302 in FIG. 3. The degree of impedance discontinuity produced in the structure of FIG. 3 is obviously not as complete as that produced in the structure of FIG. 2 but is still adequate to make the antenna system incorporating the structure of FIG. 3 operative and acceptable. The advantage of the structure of FIG. 3 is that it does not require severance of column 200 and thus eliminates the mechanical problems, such as loss of structural strength, associated with such severance.

In FIG. 7, column 200 is severed so as to present two conical, nesting sections insulated from each other but bound to each other by insulating adhesive 700 which may be of the epoxy family.

In FIG. 7A the insulating adhesive of FIG. 7 is replaced by brazing material 702 which inherently has electrical resistance greater than the material of column 200. A relatively minor increase in resistance between terminals 204 and 205 will permit operation of the subject antenna system.

It should be noted that column 200 in FIGS. 2, 3, 7 and 7A is representative of any of the columns 11, 12, 13 and 14 in FIG. 1 and that a combination of the methods of FIGS. 2, 3, 7 and 7A for producing impedance discontinuities may be used.

Experiments have shown that the inductance appearing between terminals 204 and 205 in FIGS. 2 and 7 approximates 2 microhenries in the average car body produced today. To maximize the signal potential appearing across those terminals it is desirable to shunt a condenser across those terminals (either directly or through other elements) of such magnitude as to produce parallel resonance at the frequency or frequencies of intended operation for the antenna system which is the subject of this invention. At one frequency a shunting capacitor is required having a value determined from the equation:

$$fr = \frac{I}{2\pi\sqrt{LC}}$$

At 1000 kiloherz and with an inductance of 2 microhenries the value of $C$ for resonance is found to be 0.025 microfarads. To tune this antenna system over a band of frequencies it is apparent that the value of $C$ must be varied. For example, the United States broadcast band covers the range from 550 to 1600 kiloherz, a 3 to 1 frequency range, requiring, for a fixed inductance, a capacitance variation of about 9 to 1. This range of variation may be obtained by a mechanically or electrically variable capacitance located immediately proximate to terminals 204, 205, and connected thereacross with the control for varying such capacitance located remotely, for example in a radio utilizing the subject antenna system; or the antenna tuning reactance (inductive or capacitive) itself may be located remotely from terminals 204, 205 in a fashion described more completely in connection with FIG. 6 and claimed in copending application Ser. No. 427,259 filed Dec. 21, 1973, by this inventor. Of course the distributed capacitance over the length of the coaxial cable between the tuning means and the discontinuity reduces the value of lumped capacitance required for resonance at a given frequency. Thus as the cable is increased in length, the size of the tuning capacitance becomes more practical.

In the embodiment of FIG. 3 the inductive reactance appearing across terminals 301, 302 will vary depending on the permeability of the ferrite material used and the length of column 200 covered by ferrite material 300, but an attempt should be made to achieve a minimum apparent inductance of 2 microhenries between terminals 301 and 302 so that a resonating capacitor of practical size may be utilized when tuning that inductive reactance directly.

While the discussion thus far has related to reception or radiation of signals at broadcast frequencies the invention is equally applicable to signal reception or transmission at other frequencies, for example in the F-M band at approximately 100 megaherz. At that frequency the 2 microhenry inductance appearing across terminals 204, 205 may be resonated with a capacitor having a value of 0.00025 microfarads, a very practical size for a variable tuning capacitor. Use of this invention in the citizen's band at 27 megaherz is equally practical both for transmission and reception.

In the energy coupling system 408 of FIG. 4 the potential appearing across terminals 204 and 205 is stepped up by the auto-transformer action produced by conductive sheath or tubing 400 (which may be covered by a ferrite jacket 401 to produce magnetic shielding and greater transformer action) acting as a primary and the winding formed by conductor 402 passing through conductive sheath or tubing 400 several times, acting as a secondary. The method for tuning the system and coupling the output signal from the secondary of the auto-transformer to the associated electronics, in this case a radio receiver, is set forth in FIG. 6 and will be discussed in connection therewith. Conductive segments 403, 404 and 405 which pass through shield 407, are extensions of conductor 402 and are used to couple the signals to and from the antenna to the tuning system of FIG. 6.

In FIG. 5 duplicates of the energy coupling system 408 of FIG. 4 are shown incorporated as coupling systems 408A and 408B, one in each of two columns 500 and 501, respectively, of car body 502. The purpose of taking energy from the two columns instead of from one is to achieve omnidirectionality, or at least approach it. The respective signals from columns 500 and 501 are carried from duplicate energy coupling systems 408A and 408B through shielding sheaths 409A and 409B, respectively, to electronics 505, for the purpose of this example the input tuning circuits for a radio receiver, such tuning circuits being described more fully in connection with FIG. 6.

In FIG. 6, with energy coupling system 408A connected between points 506 and 507 of FIG. 5, condenser 602 resonates, at the desired frequency, the secondary of the autotransformer included in coupling system 408A. That auto-transformer, as has been described in connection with FIG. 4, includes a conductive sheath or tube coupled directly across a conductive-body discontinuity and constitutes a one-turn primary through which the secondary winding passes to effect extremely tight magnetic coupling between the primary and secondary of the transformer. By surrounding the one-turn primary with high-permeability ferrite material, the inductive reactance of the primary is made approximately equal to the reactance appearing at the body discontinuity and maximum signal energy transfer from the body to the primary is effected. The ferrite covering also increases and confines the magnetic coupling between the primary and the secondary windings in the auto-transformer so that optimum signal transfer and voltage step-up is obtained in the higher impedance secondary. Secondary resonating condenser 602 is centrally connected in the auto-transformer secondary formed by conductor 402 passing a plurality of times through sheath 400 (the primary winding) of energy coupling system 408A. Condenser 602 resonates that secondary at the desired frequency with the results described more fully hereinafter. Conductor 405 of the auto-transformer secondary is connected to padding condenser 410 to develop proper coupling of the signal voltage into the low impedance end of R. F. tuning coil 601 in the radio receiver input. Padding condenser 410 and tuning condenser 602 together resonate the transformer secondary. The R. F. voltage obtained from across padding condenser 410 as applied to the low impedance end of the variable inductive tuner 601 is proportional to the ratio between the magnitude of the capacitance of tuning condenser 602 and the magnitude of the capacitance of padding condenser 410. Thus, at high frequencies where input coupling must be minimized, this condition produces minimal coupling. As the resonant frequency is lowered by increasing the magnitude of capacitance of tuning condenser 602, the coupling ratio changes by operation of padding condenser 410, and an increased R. F. voltage is applied between the low potential end of variable input tuning inductance 601 and ground. Similarly, a greater R. F. voltage appears across secondary 611.

As has already been indicated, conductor 405, connected to the auto-transformer side of condenser 410 in FIG. 4, is connected at its opposite end to terminal 603 of radio input tuning indicator 601. Terminal 603 is also connected to fixed contact 604 of relay switch 605. Movable contact 606 of switch 605 is connected to ground. The remaining fixed contact 607 is connected to conductor 608 in conductive tube or sheath 409B, which, at its remote end, is connected to the auto-transformer side of a padding condenser in coupling sytem 408B corresponding to padding condenser 410 in energy coupling system 408A. Condenser 609 tunes the secondary of the auto-transformer in coupling system 408B. Input secondary 611 is inductively coupled to tuning inductor 601 and is connected to the input stage of the associated car radio. Switch or relay 605 permits maximization of the desired signal introduced into the associated radio circuits. With contact 606 in the position shown the input signal is derived from both discontinuities in the body. These two signals exhibit differing directional characteristics and their combination can give omni-directional reception. With contact 606 moved into connection with contact 607, the output signal from system 408B is grounded and only the signal from system 408A reaches the secondary 611. Switch 605 may be manually or automatically operated in response to changes in signal strengths in the two coupling systems 408A and 408B.

In FIG. 8, edge 800, having discontinuity 801 therein acts as the primary of an auto-transformer, the secondary of which includes conductors 802, 803, 804 and 805. This secondary is not only directly driven by the signal voltage appearing across discontinuity 801 but also is inductively driven by edge 800 bounding discontinuity 806. The secondary winding may be enclosed by the trim material normally found around a discontinuity in a car body.

The secondary is tuned at its center by capacitor 807 through conductors 803 and 804. Signals are taken from the secondary by conductors 808 and fed to the receiver input circuits. The level of those signals is determined in part, by the size of padding condenser 809. Main tuning inductance 810 may be ganged with secondary tuning condenser 807 to optimize the system's performance. Sense antenna 811 may be provided, if desired, to given improved performance under certain circumstances. The car body acts as an electrostatic shield with respect to signals from certain directions, both with respect to the sense antenna and the R. F. auto-transformer secondary.

While specific embodiments have been described, modifications may be made within the scope of the invention. The following claims are intended to cover such embodiments.

What is claimed is:

1. An antenna system for operation at at least one intended frequency, said antenna system including:

an electrically conductive three-dimensional body forming a closed loop for the flow of radio frequency signals therethrough at said at least one intended frequency when said body is exposed to a radio frequency field, said loop having a length which is short with respect to a resonant fraction of a wavelength at said intended frequency;

a column of relatively reduced cross-sectional area connecting major surfaces of said body and through which said radio frequency signals tend to flow;

means cooperating with said column portion for increasing the electrical impedance of a segment of said column portion; and, body resonating means connected directly to said column portion across said segment for producing forced electrical resonance of said body at said intended frequency.

2. Apparatus according to claim 1 in which said body resonating means is a capacitor.

3. Apparatus according to claim 2 in which said three-dimensional body is a vehicle body.

4. Apparatus according to claim 3 in which said vehicle is an automobile, said column portion is a window column, said means for increasing the electrical impedance of a segment of said column portion is an electrical insulator interposed in said column portion for the length of said segment, and said resonating means is a variable capacitor.

* * * * *